US007281459B2

(12) United States Patent
Zhang et al.

(10) Patent No.: US 7,281,459 B2
(45) Date of Patent: Oct. 16, 2007

(54) TORQUE REGULATING ASSEMBLY

(75) Inventors: Guo-Wei Zhang, Luoshan County (CN); Rui Zhang, Luoshan County (CN); Dong Liang, Cinjhou (CN)

(73) Assignee: Lite-On Technology Corporation, Taipei (TW)

( * ) Notice: Subject to any disclaimer, the term of this patent is extended or adjusted under 35 U.S.C. 154(b) by 0 days.

(21) Appl. No.: 11/387,920

(22) Filed: Mar. 24, 2006

(65) Prior Publication Data

US 2007/0125206 A1 Jun. 7, 2007

(30) Foreign Application Priority Data

Dec. 7, 2005 (TW) ..... 94221314 U

(51) Int. Cl.
*B25B 23/157* (2006.01)

(52) U.S. Cl. ..... 81/475; 81/467

(58) Field of Classification Search ..... 81/473–476, 81/467; 173/178
See application file for complete search history.

(56) References Cited

U.S. PATENT DOCUMENTS 1,769,510 A * 7/1930 Herman ..... 81/475
2,536,225 A * 1/1951 Rice ..... 81/475
2,930,267 A * 3/1960 Apicelli ..... 81/475
4,824,298 A * 4/1989 Lippacher et al. ..... 408/240
4,913,242 A * 4/1990 Lo ..... 173/178
6,330,846 B1 * 12/2001 Strauch ..... 81/467
7,011,001 B2 * 3/2006 Knox et al. ..... 81/467

* cited by examiner

*Primary Examiner*—Hadi Shakeri
(74) *Attorney, Agent, or Firm*—Rosenberg, Klein & Lee

(57) ABSTRACT

A torque regulating assembly includes a first tubular shell having at least one groove disposed along the longitudinal axis of the first tubular shell and a second tubular shell having at least one aperture, wherein the first tubular shell is screwed into the second tubular shell with threads, making the aperture corresponding to the groove. A torque regulating ring having at least one screw hole is put around the second tubular shell. A screwing element is screwed into the screw hole, and the front tip of the screwing element passes through the aperture and moves toward the groove, so that a position of the second tubular shell relative to the first tubular shell is fixed. Then a maximum torque value transmitted by a torque transmitting mechanism disposed inside the first tubular shell and the second tubular shell is regulated.

5 Claims, 13 Drawing Sheets

TORQUE REGULATING ASSEMBLY

BACKGROUND OF THE INVENTION

1. Field of Invention

The present invention relates to torque regulation of torque tools, and more particularly to a torque regulating assembly which can provide a precise maximum value of torque output and prevent the maximum value of torque output of the torque regulating assembly from being changed by vibration or impact, which influences the actual torque output.

2. Related Art

In general, when a screwing element such as a screw or a nut is to be drive locked by turning a tool bit (screwdriver bit, bit holder etc.) via a torque tool, a proper torque must be used according to the specification of the screwing element and the requirement for the preload, thereby such a screwing element can be surely locked without any damage due to excessive torque applied by the torque tool. Meanwhile, excessive torque can also make the screwing element have excessive preload, thus reducing the maximum value of its bearable external load. To make the torque output of manually rotated torque tools such as grab handles, pneumatic tools, and motor driven tools reach a predetermined value, a torque regulating assembly is usually applied between the torque tool and the tool bit for torque transmission, thereby limiting the maximum torque output value-of the torque tool, such that the torque of the tool bit to the screwing element is restricted at the maximum when the screwing element is being tightened.

Referring to FIGS. 1A, 1B, 2A, 2B, and 3, a conventional torque regulating assembly includes a first tubular shell 1, a second tubular shell 2, a first coupling block 3, a second coupling block 4, an elastic element 5, and a torque regulating ring 6. The first tubular shell 1 is screwed into the second tubular shell 2 with threads, and a linear relative displacement of the second tubular shell 2 to the first tubular shell is generated via relative rotation. At least one groove 1*a* is disposed at the external wall of the first tubular shell 1 along the longitudinal axis of the first tubular shell 1. The second tubular shell 2 has at least one aperture 2*a* corresponding to the groove 1*a*. The first coupling block 3 and the second coupling block 4 are disposed in the internal space formed by the first tubular shell 1 and the second tubular shell 2 together, and they press against each other to form a frictional coupling relation. The first coupling block 3 is connected to a driving shaft 7, and the driving shaft 7 is connected to a power source (not shown), for example, a pneumatic device or a power motor, disposed inside the housing 8 of the torque tool. The second coupling block 4 is connected to an output shaft 9, and the front tip of the output shaft 9 can be connected to a tool bit 9*a* of any type as desired. After the driving shaft 7 is driven by the power source, the first coupling block 3 drives the second coupling block 4 to rotate for carrying out the torque transmission, making the output shaft 8 drive the tool bit 9*a* to tighten a screwing element (not shown). The coupling force between the first coupling block 3 and the second coupling block 4 is determined by the normal force between the first coupling block 3 and the second coupling block 4, and the coupling force can determine the maximum torque transmitted between the first coupling block-3 and the second coupling block 4. The elastic element 5 presses against the second coupling block 4 and the second tubular shell 2 respectively with two ends, for generating an elastic force to push the second coupling block 4 pressing against the first coupling block 3, so as to produce the aforementioned normal force.

The torque regulating ring 6 is put around the second tubular shell 2. An elastic ring 6*a* is disposed in the regulating ring 6, just covering the aperture 2*a*, and pushes a positioning ball 6*b* into the groove 1*a* through the aperture 2*a* to move. The positioning ball 6*b* is partly located in the groove 1*a*, and partly located in the aperture 2*a* to fix the relative positions of the first tubular shell 1 and the second tubular shell 2, avoiding linear relative displacement between the first tubular shell 1 and the second tubular shell 2 due to their relative rotation, and meanwhile to fix the length of the elastic element 5, for generating a constant elastic force to push the second coupling block 4. If the torque transmitted by the first coupling block 3 and the second coupling block 4 is greater than the coupling force between them, the first coupling block 3 and the second coupling block 4 cannot be coupled with each other in time, resulting in idleness of the first coupling block 3, as shown in FIG. 3, therefore, they cannot transmit larger torque than predetermined, thereby the screwing element is tightened with a proper torque. By making the second tubular shell 2 rotate relative to the first tubular shell 1 to generate a linear relative displacement, the length of the elastic element 5 can be altered, so as to change the maximum value of the torque output by the torque tool. During the process, the positioning ball 6*b* first disengages from the groove 1*a*, slides along the outer surface of the first tubular shell 1, and then again engages into the groove 1*a* to fix the second tubular shell 2, thereby preventing the second tubular shell 2 from rotating relative to the first tubular shell 1 as the torque tool is operated. However, in the conventional torque regulating assembly, the design of using the elastic ring 6*a* to push the positioning ball 6*b* has the advantages of being easy to operate and the torque being able to be quickly switched without any tool, the elastic force of the elastic ring 6*a* cannot be changed in accordance with the working condition for improving the positioning effect of the positioning ball 6*b*. The impact and vibration occurring during tightening the screwing element often cause the positioning ball 6*b* to disengage from the groove 1*a*, making the second tubular shell 2 rotate relative to the first tubular shell 1 and resulting in a linear relative displacement, which changes the maximum value of the torque output and causes difficulty in usage. Besides, the elastic ring 6*a* may be elastic fatigue after long-term operation, thus it becomes more likely that the positioning ball 6*b* will disengage from the groove 1*a*.

SUMMARY OF THE INVENTION

In view of the aforesaid problem, the object of the invention is to provide a torque regulating assembly, for fixing the maximum value of the torque output at the preset value, instead of being changed when the torque regulating assembly suffers from external impact, vibration, or operation mistakes.

To achieve the above object, the torque regulating assembly of the invention includes a first tubular shell and a second tubular shell. The first tubular shell is screwed into the second tubular shell with threads, so that a linear relative displacement of the second tubular shell to the first tubular shell is generated via relative rotation of the first tubular shell and the second tubular shell to perform, wherein the first tubular shell has at least one groove disposed externally along the longitudinal axis of the first tubular shell, and the second tubular shell has at least one aperture, corresponding to the groove.

A first coupling block and a second coupling block are disposed in the internal space formed by the first tubular shell and the second tubular shell together. The second coupling block presses against the first coupling block for the two to be coupled with each other. By using the frictional force, the first coupling block can drive the second coupling block to rotate for carrying out the torque transmission.

An elastic element is provided with two ends respectively pressing against the second tubular shell and the second coupling block, for generates an elastic force to push the second coupling block to press against the first coupling block. The normal force of the second coupling block against the first coupling block can be altered by changing the elastic force of the elastic element, thereby changing the maximum value of the torque transmitted between the first coupling block and the second coupling block.

An elastic ring is put around the second tubular shell, and covers the aperture. A positioning ball is disposed in the aperture. The elastic ring generates an elastic force to push the positioning ball, making the positioning ball pass through the aperture and partly engaged in the groove, so as to prevent the second tubular shell rotating relative to the first tubular shell, and fix the length of the elastic element to make its elastic force to keep constant.

A torque regulating ring is put around the second tubular shell and covers the elastic ring. The torque regulating ring has at least one screw hole corresponding to the aperture of the second tubular shell for a screwing element to be screw into. The screwing element can be pressed against the elastic ring, and generate a pressing force against the positioning ball, making the positioning ball unable to be disengaged from the groove, thereby, enhancing the positioning effect of the positioning ball, and effectively fixing the torque output value of the torque regulating assembly.

The function of the present invention lies in that by using the front tip of the screwing element to press against the elastic ring as well as the positioning ball. The positioning effect of the positioning ball to the second tubular shell can be enhanced in a situation that the positioning ball is easily to be disengaged from the groove, so that the maximum value of the torque output of the torque regulating assembly can be prevented from being changed by position alteration of the second tubular shell. Meanwhile, the torque regulating assembly is still easy to be operated for setting a predetermined value of the maximum torque output.

Furthermore, the elastic ring and the positioning ball may be removed, and the front tip of the screwing element may be directly inserted into the groove to fix the second tubular shell, and preventing the second tubular shell from rotating relative to the first shell to generate relative displacement.

The above illustration of the content of the present invention and the following illustration of the embodiments are used to demonstrate and explain the principle of the invention, and provide further explanation for the claims of the invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, and which thus is not limitative of the present invention, and wherein.

DETAILED DESCRIPTION OF THE INVENTION

To get a further understanding of the objects, structures, features, and functions of the present invention, it will be illustrated in detail below with embodiments.

The torque regulating assembly provided by the embodiments of the invention is used to regulate the maximum torque output of a torque tool, such as a power screwdriver or an air screwdriver, so as to prevent the tool bits, or screws and nuts to be tightened from being damaged due to excessive torque output. For illustrating, the embodiments particularly take as an example a power screwdriver for tightening or loosening a screw. The torque regulating assembly according the embodiments of the invention is disposed at the output shaft of a power screwdriver, for limiting the maximum torque output of the power screwdriver, so as to prevent the screwdriver head from being damaged due to excessive torque, prevent the screw thread from being cracked, and meanwhile prevent the workpieces to be processed from being damaged due to excessive tightening force of the screw, and avoid excessive preload on the screw itself.

Referring to FIGS. 4A, 4B, 5, and 6, a schematic sectional view of the torque regulating assembly according to the first embodiment of the invention is shown in the figures, with its structure and composition illustrated in detail as follows.

A driving shaft 110 is disposed in the housing 100 of a torque tool, and protrudes out of the housing 100 through the bearing 120 disposed in the housing 100. In the embodiment, the torque tool is a power screwdriver. One end of the driving shaft 110 is connected to a pneumatic device or a power motor (not shown) disposed in the housing 100, while the other end extends to the exterior of the housing 100 through the bearing 120 and a first coupling block 111 is connected to the driving shaft 110.

Figure 1A:
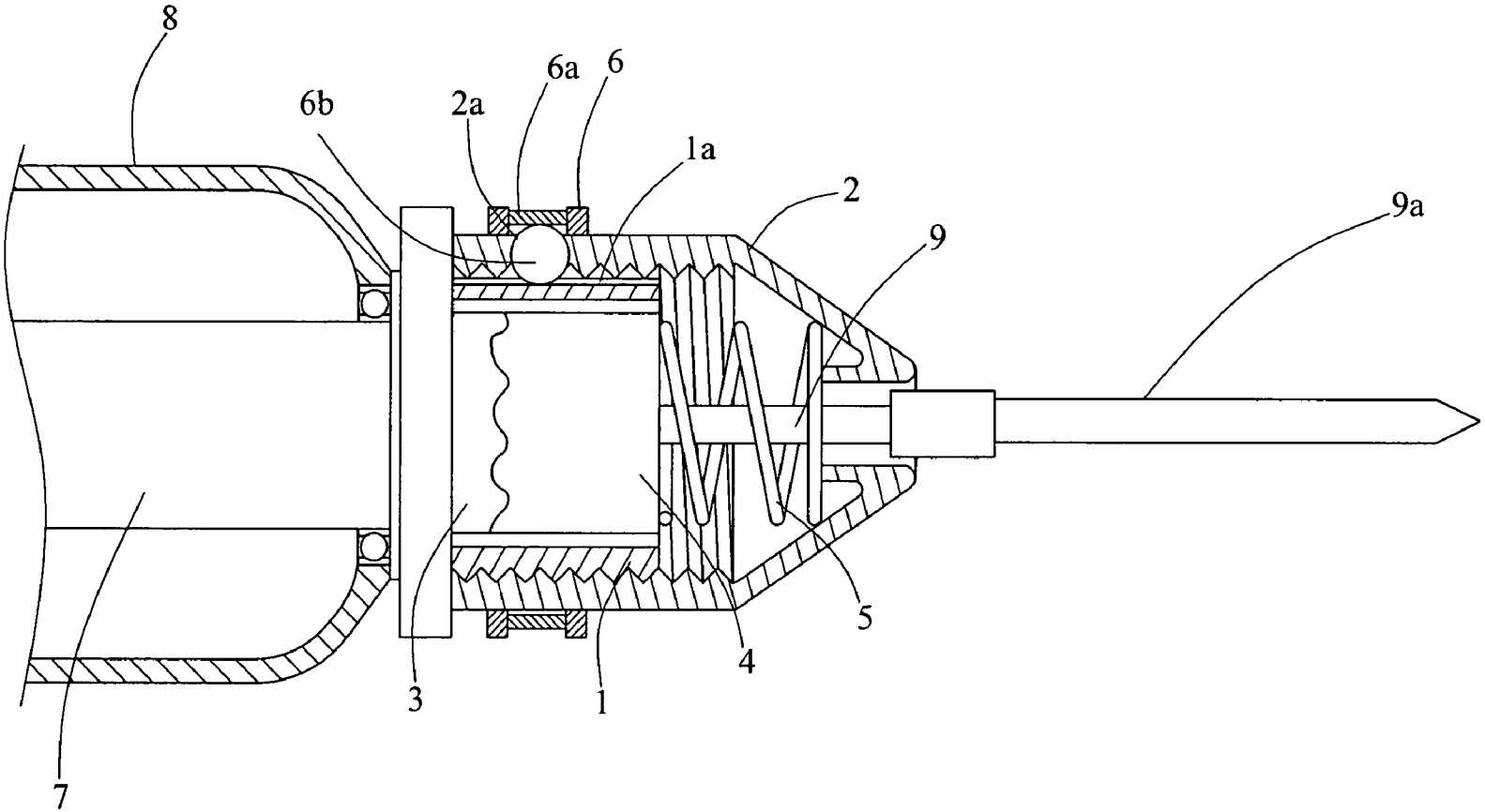
FIG.1A (PRIOR ART)
FIG. 1A is a schematic sectional view of a conventional torque regulating assembly.
Figure 1B:
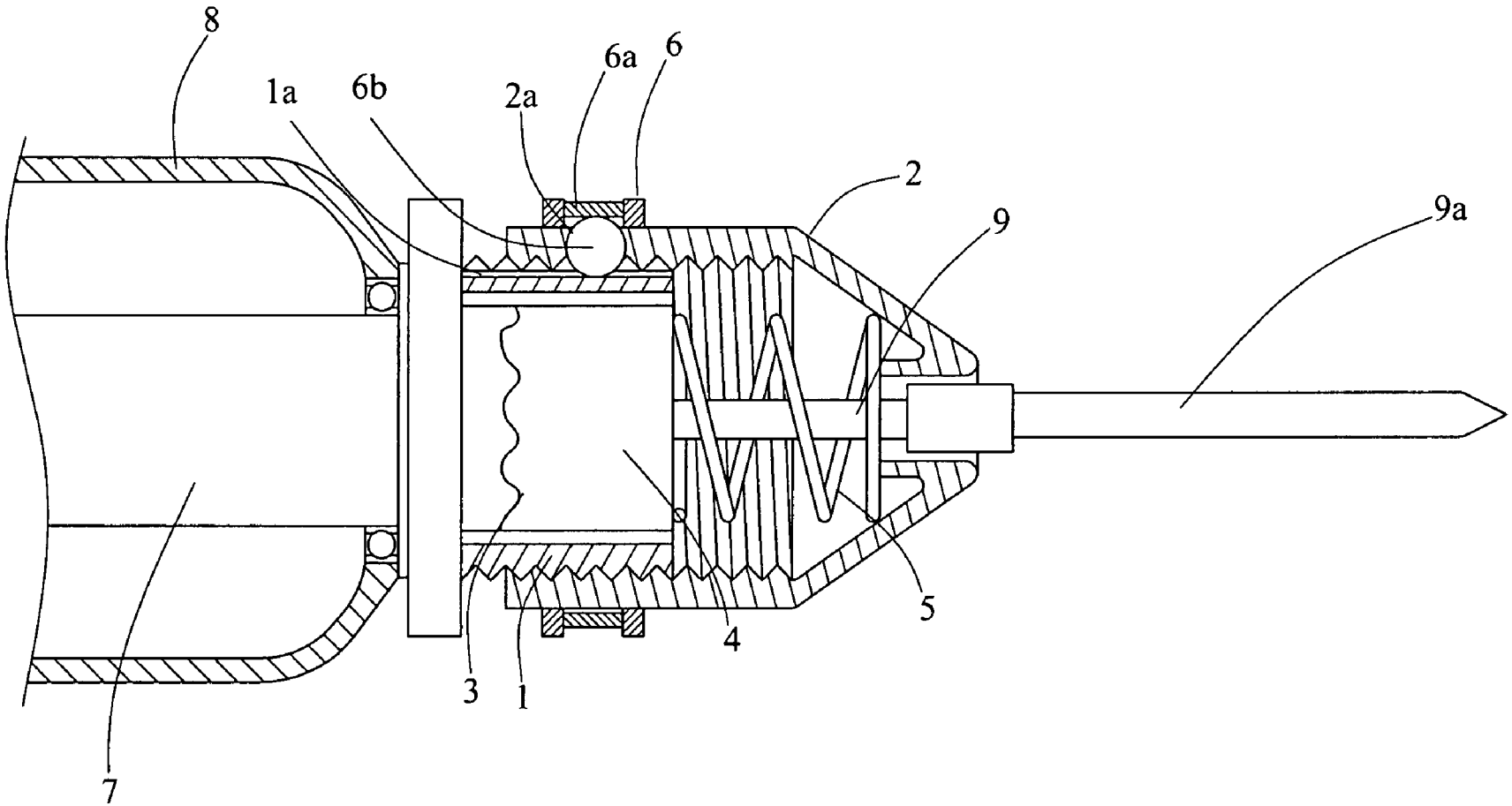
FIG.1B (PRIOR ART)
FIG. 1B is anther schematic sectional view of the conventional torque regulating assembly.
Figure 2A:
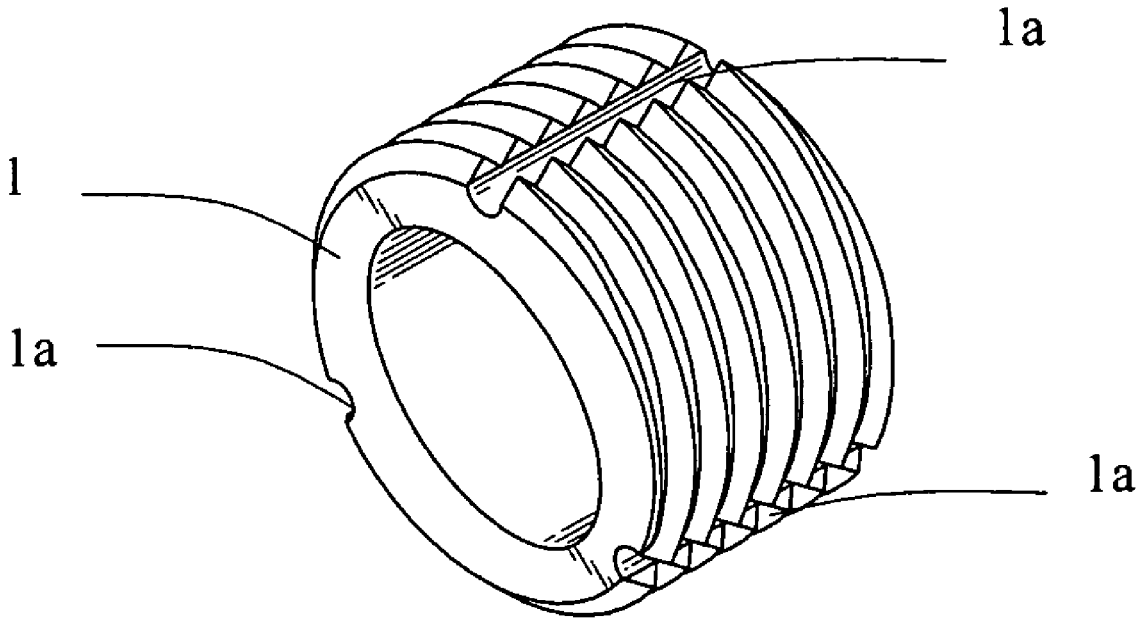
FIG.2A (PRIOR ART)
FIG. 2A is a perspective view of the first tubular shell according to the conventional torque regulating assembly.
Figure 2B:
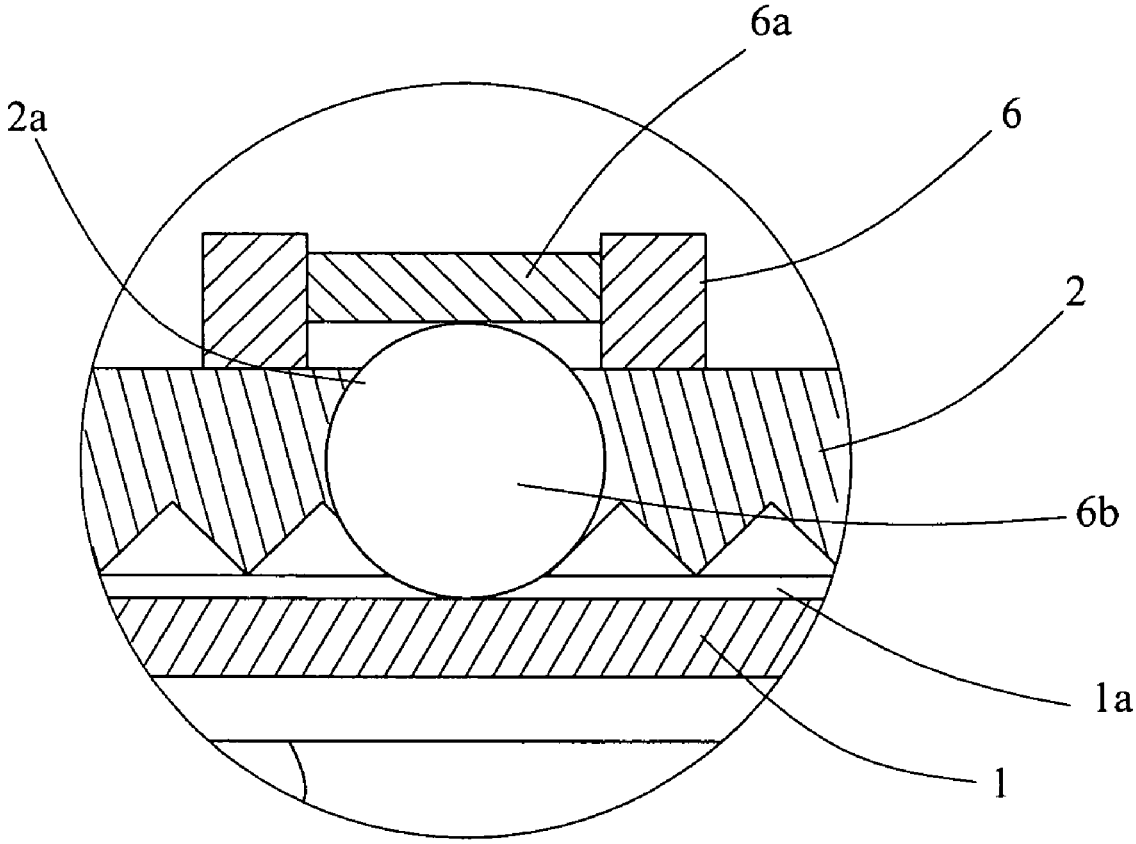
FIG.2B (PRIOR ART)
FIG. 2B is a partial enlarged view of FIG. 1A.
Figure 3:
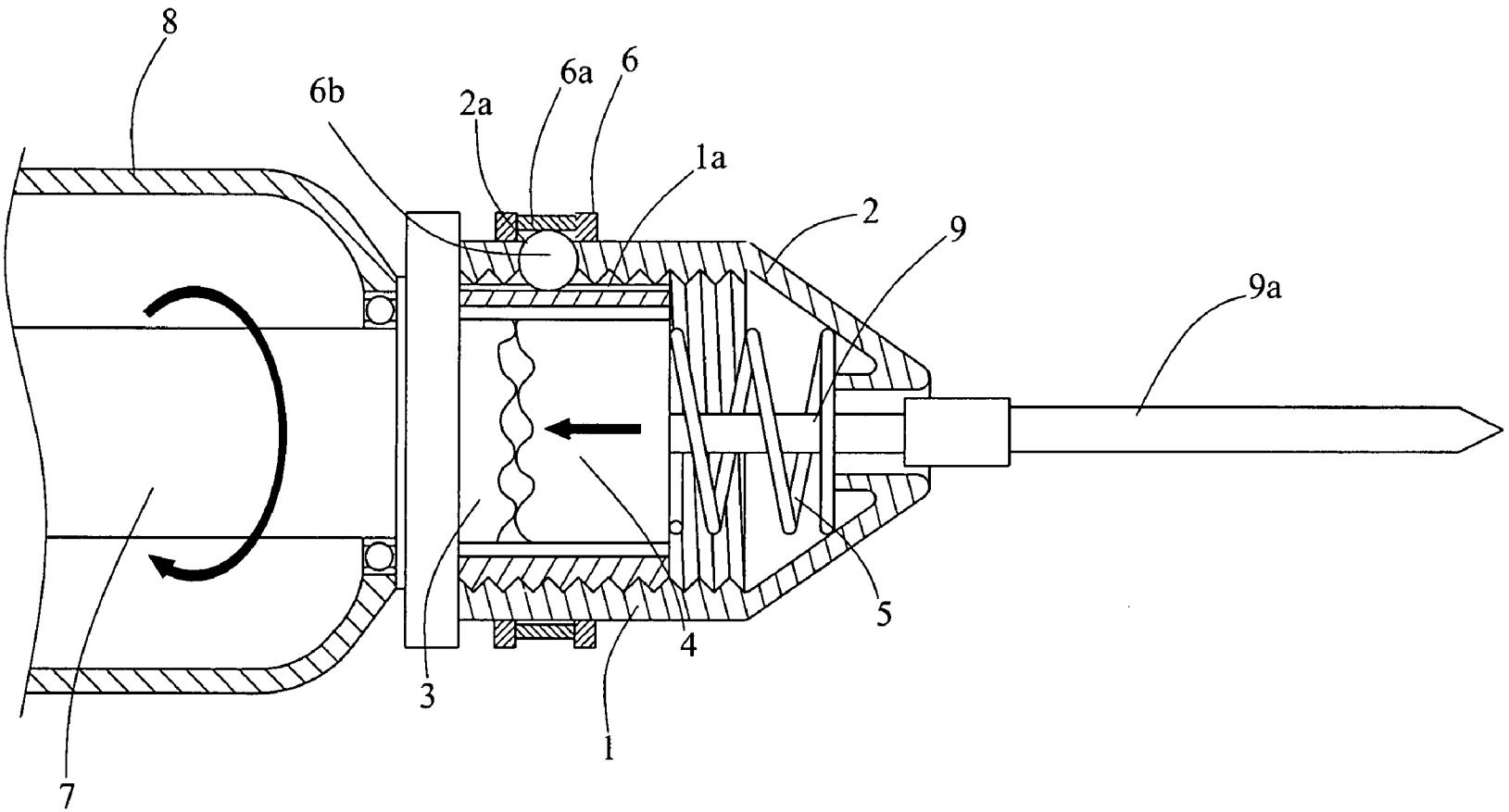
FIG.3 (PRIOR ART)
FIG. 3 is a schematic sectional view of the conventional torque regulating assembly when reaching the maximum value of the torque output.
Figure 4A:
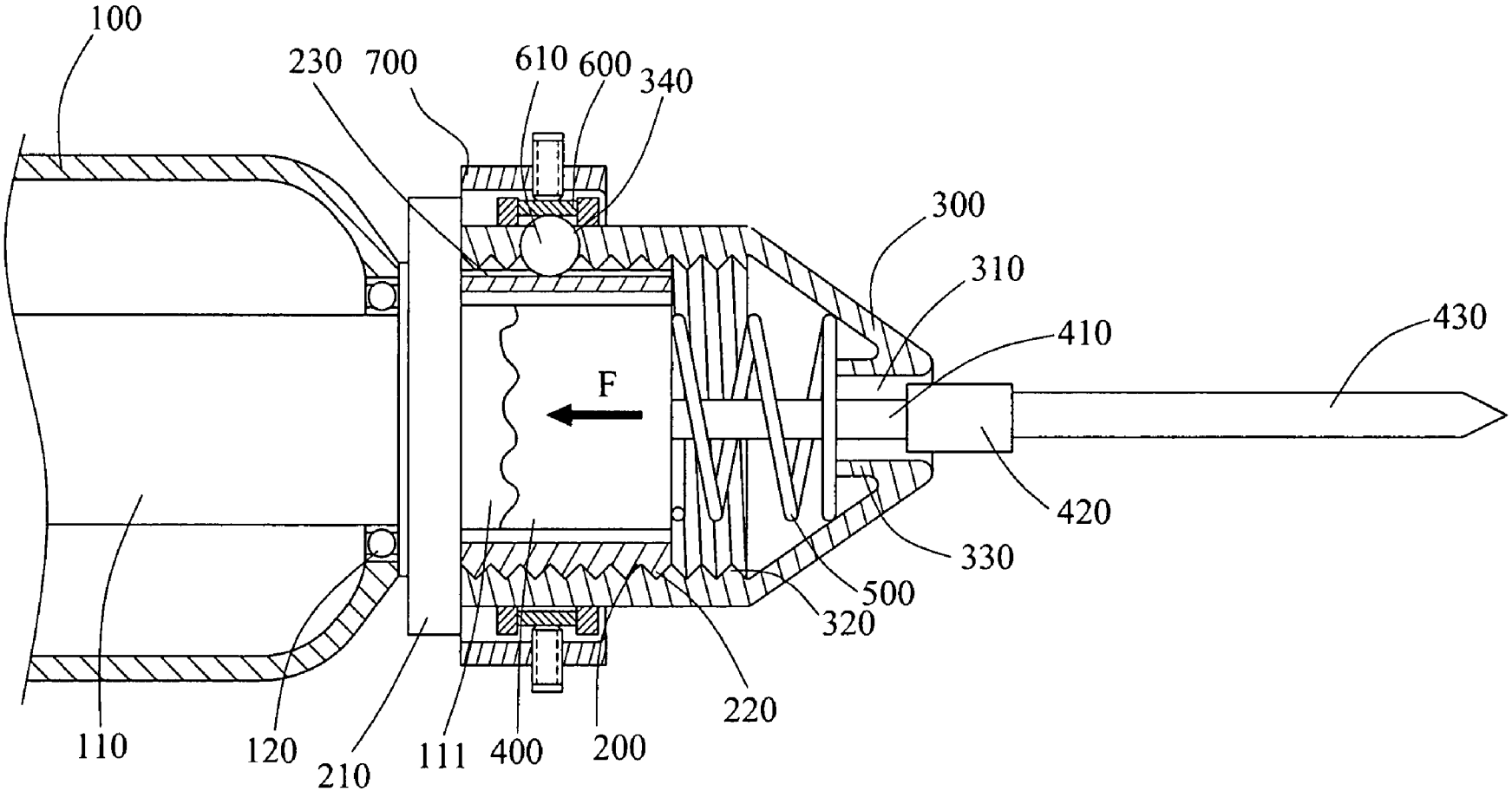
FIG. 4A is a schematic sectional view of the first embodiment of the invention.
Figure 4B:
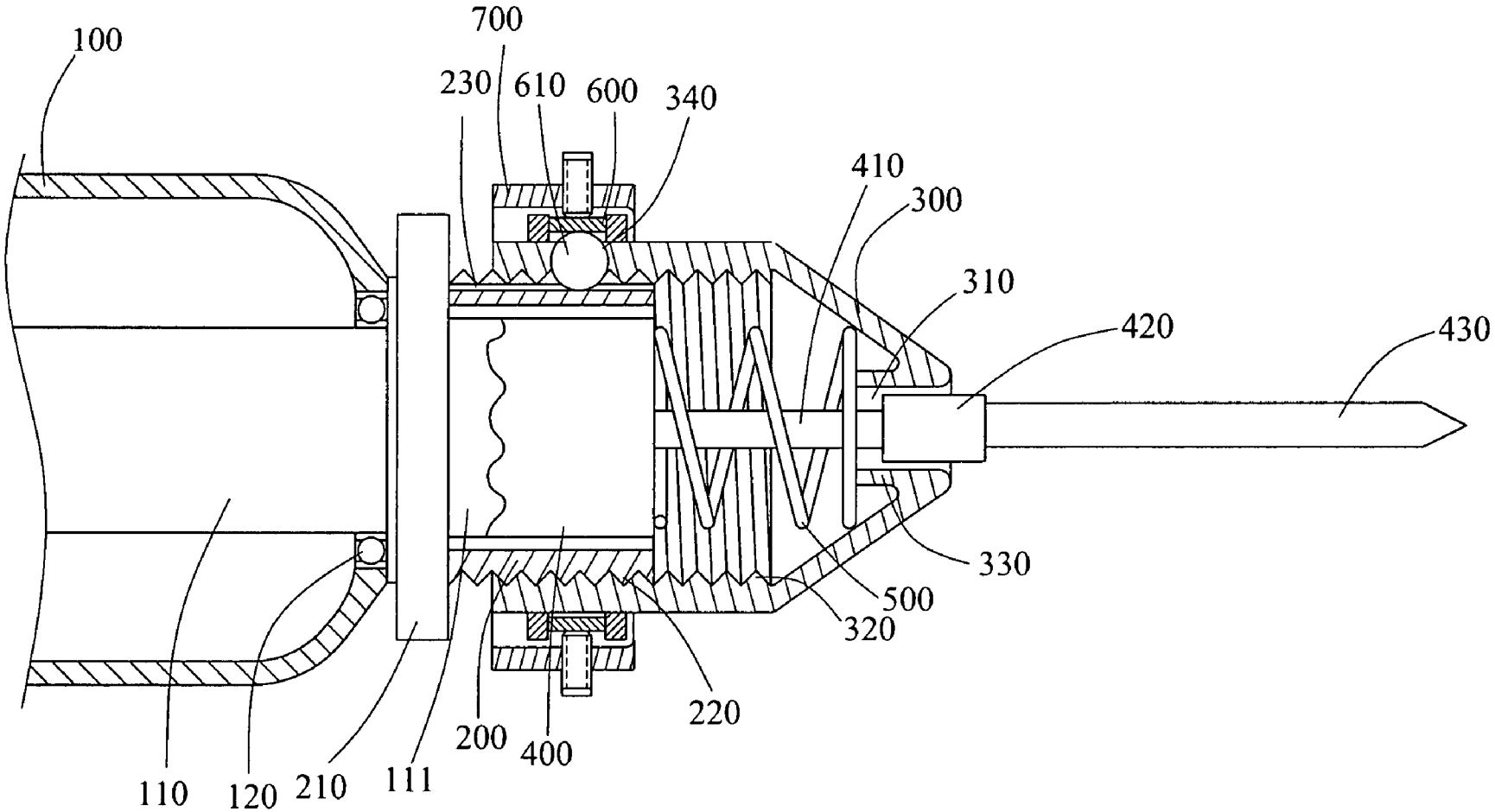
FIG. 4B is another schematic sectional view of the first embodiment of the invention.
Figure 5:
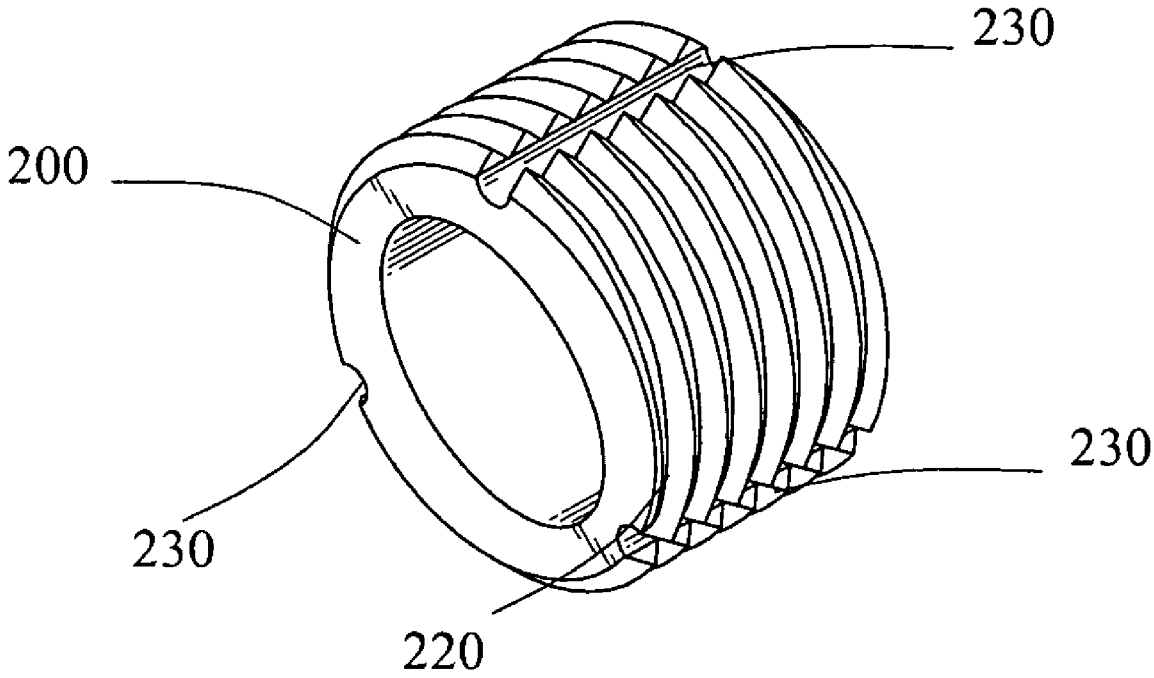
FIG. 5 is a perspective view of the appearance of the first tubular shell according to the first embodiment of the invention.
Figure 6:
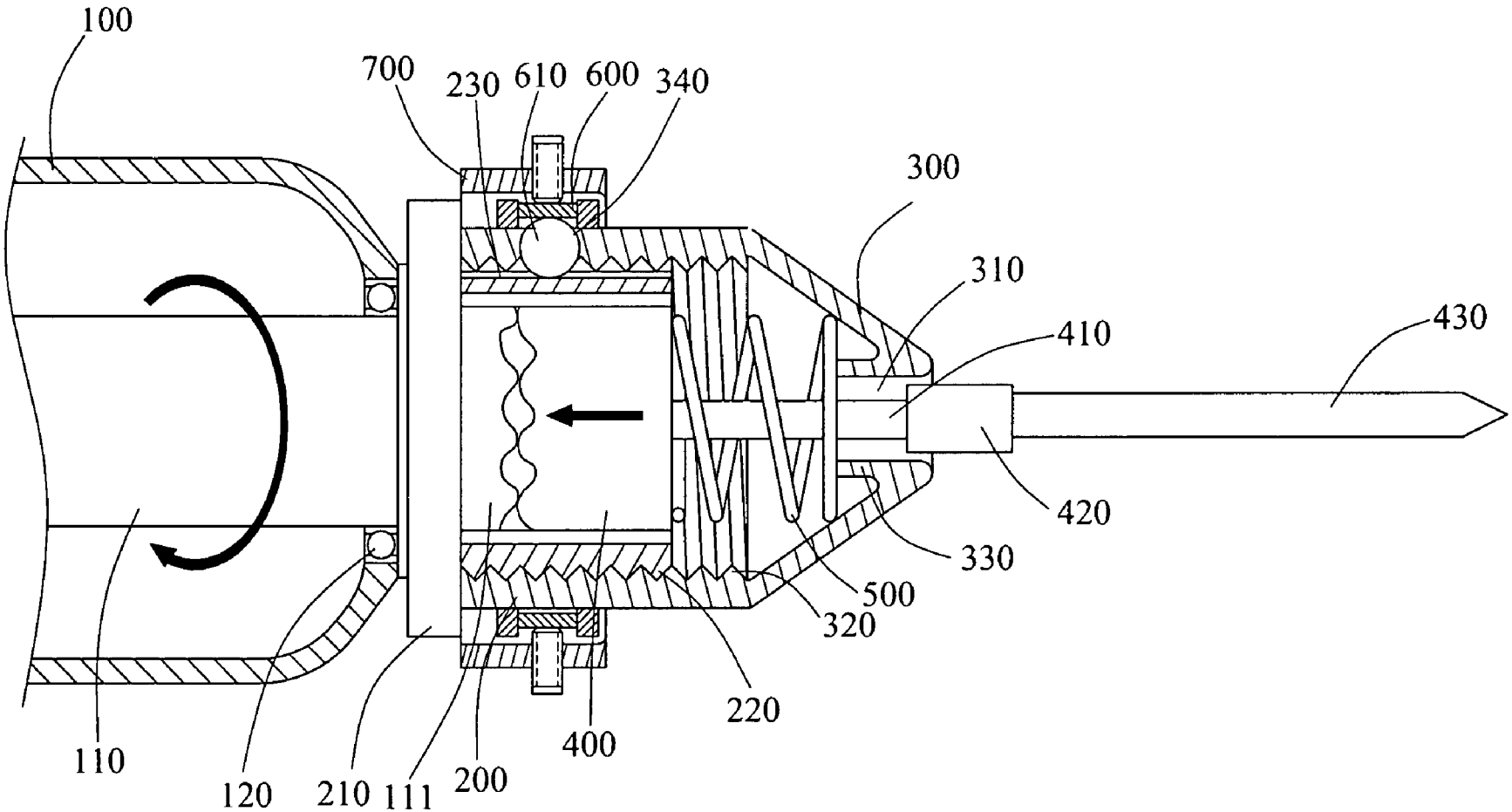
FIG. 6 is a schematic sectional view according to the first embodiment of the invention when reaching the maximum value of the torque output.

A first tubular shell 200 is fixed to the exterior of the housing 100 via a fixing ring 210. The first tubular shell 200 is disposed coaxial with the bearing 120. And the first tubular shell 200 has a screw thread 220 formed at its external wall and a plurality of grooves 230 disposed at its external wall, wherein each groove 230 is disposed along the longitudinal axis of the first tubular shell 200, as shown in FIG. 5. There can be one or more grooves 230, and in the present embodiment, there are three grooves 230.

Figure 7:
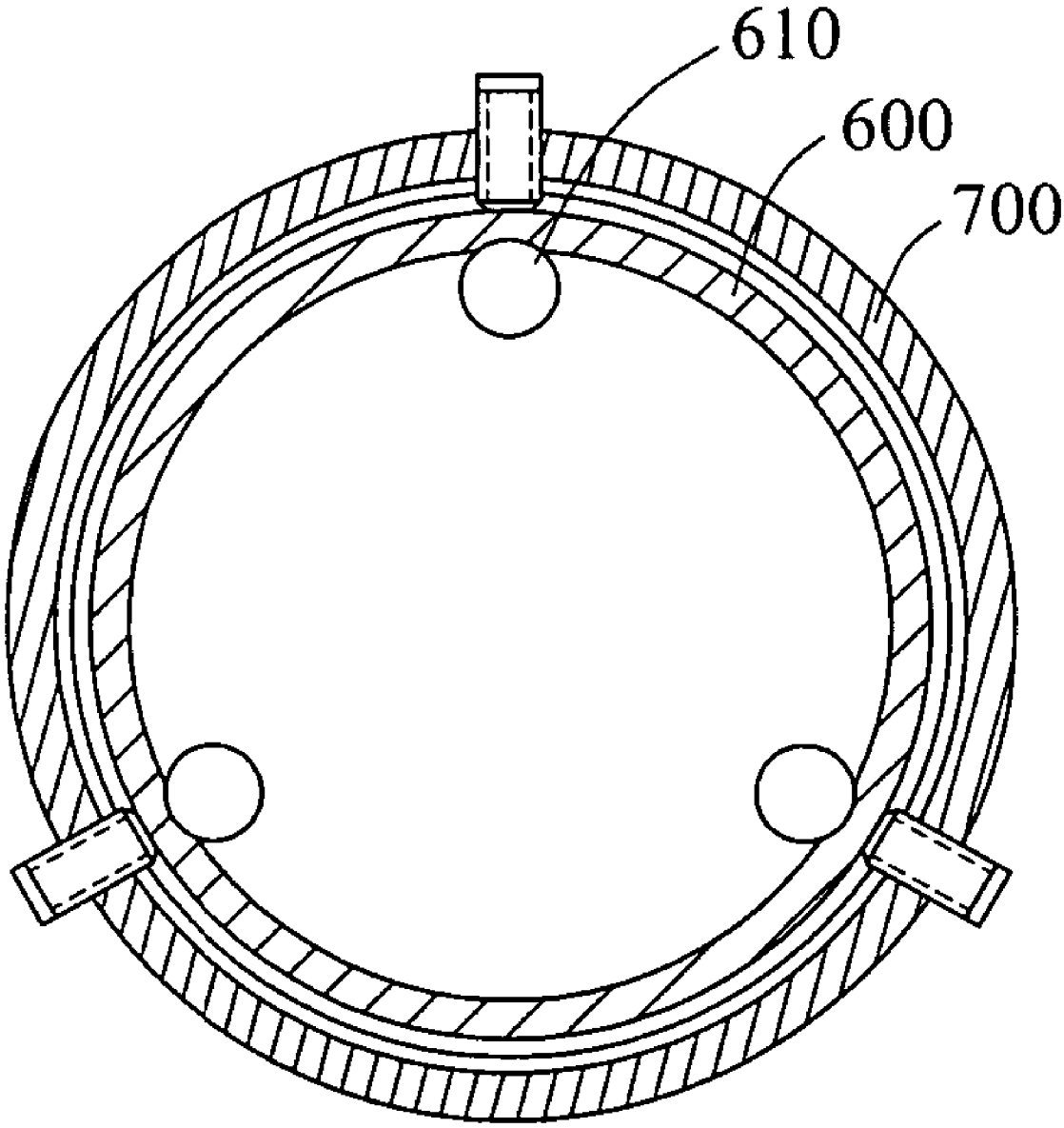
FIG. 7 is a schematic sectional view of the torque regulating ring, elastic ring, positioning ball, and the screwing element along the radial direction according to the first embodiment of the invention.

A second tubular shell 300 has one end disposed at the exterior of the first tubular shell 200 and the other end gradually contracted to form an opening 310. The internal wall of the second tubular shell 300 is provided with a screw thread 320, matching with the screw thread 220 at the external wall of the first tubular shell 200 to form a screwing relation. So that the first tubular shell 200 is screwed into the second tubular shell 300 with the thread 220,320 for enabling the first tubular shell 200 and the second tubular shell 300 to relatively rotate to generate a linear relative movement. A tubular rib 330 extending toward the interior of the second tubular shell 300 is formed at the edge of the opening 310. A plurality of apertures 340 are disposed in the second tubular shell 300, wherein each aperture 340 is positioned on the same radial cross section of the second tubular shell 300, and there can be one or more apertures 340 corresponding to the number of the grooves 230 of the first tubular shell 200. Meanwhile, each aperture 340 can respectively correspond to different grooves 230. Take the present embodiment as an example. There are three apertures 340 (as shown in FIG. 7), matching with the number of the grooves 230. After the first-tubular shell 200 and the second tubular shell 300 relatively rotate an angle, the individual apertures 340 can overlap the grooves 230 of the first tubular shell 200.

A second coupling block 400, together with the first coupling block 111, is disposed in the internal space formed by the first tubular shell 200 and the second tubular shell 300.

An elastic element 500 such as a compression spring has one end pressing against the second coupling block 400, and the other end put around the rib 330 inside the second tubular shell 300. So that the elastic element 500 is provided with two ends respectively pressing the second tubular shell 300 and second coupling block 400 for generating an elastic force to constantly push the second coupling block 400 pressing against the first coupling block 111, making the second coupling block 400 apply a normal force to the first coupling block 111. Therefore, the second coupling block 400 and the first coupling block 111 are coupled with each other, enabling the second coupling block 400 and the first coupling block 111 to rotate together to form a torque transmitting mechanism. Thus, the driving shaft 110 can be used to drive an output shaft 410 connected to the second coupling block 400 to rotate. A connecting seat 420 is disposed at the front tip of the output shaft 410. A tool bit 430, for such as a screwdriver head is fixed onto the connecting seat 420 through the opening 310 of the second tubular shell 300, and is driven by the power output of the driving shaft 110 to rotate. The normal force F to the first coupling block 111 generated by the second coupling block 400 can determine the coupling force between the first coupling block 111 and the second coupling block 400. When the torque applied by the output shaft 410 to the tool bit 430 exceeds the coupling force between the first coupling block 111 and the second coupling block 400, offset will occur between the first coupling block 111 and the second coupling block 400, as shown in FIG. 5. The first coupling block 111 will idle at this time, incapable of driving the second coupling block 400, and as a result, the output shaft 410 cannot rotate the tool bit 430 with a torque greater than a predetermined value. The normal force F is changed by a linear relative displacement of the second tubular shell 200 to the first tubular shell 100 that is generated via their relatively rotation. The relative position of the first tubular shell 200 and the second tubular shell 300 is changed, thereby altering the length of the elastic element 500 and further altering the elastic force for pushing the second coupling block 400. Thus, the effect of regulating the maximum torque output of the output shaft 410 is achieved by altering the value of the normal force F.

To fix the relative position of the first tubular shell 200 and the second tubular shell 300, the present embodiment further includes an elastic ring 600 and one or more positioning balls 610, wherein each positioning ball 610 is disposed in the apertures 340 of the second tubular shell 300, and is partly engaged into the groove 230 of the first tubular shell 200 through the aperture 340. The elastic ring 600 covers the aperture 340 and presses against the positioning ball 610, for generating a constant elastic force to push the positioning ball 610 against the first tubular shell 200. As a part of the positioning ball 610 is disposed in the aperture 340 of the second tubular shell 300, and the other part is engaged in the groove 230 of the first tubular shell 200, a fixing effect can be formed to make the first tubular shell 200 unable to rotate relative to the second tubular shell 300 to perform a relative linear movement, thereby the maximum value of the torque transmitted between the first coupling block 111 and the second coupling block 400 is fixed. By forcing the second tubular shell 300 to drive, the positioning ball 610 can be disengaged from the groove 230 to drive the second tubular shell 300 and change its relative position with the first tubular shell 200, so as to change the maximum value of the transmitted torque. At this time, the positioning ball 610 can slide on the surface of the first tubular shell 200. Then the positioning ball will be engaged into another groove 230 to form the fixing effect.

Figure 8:
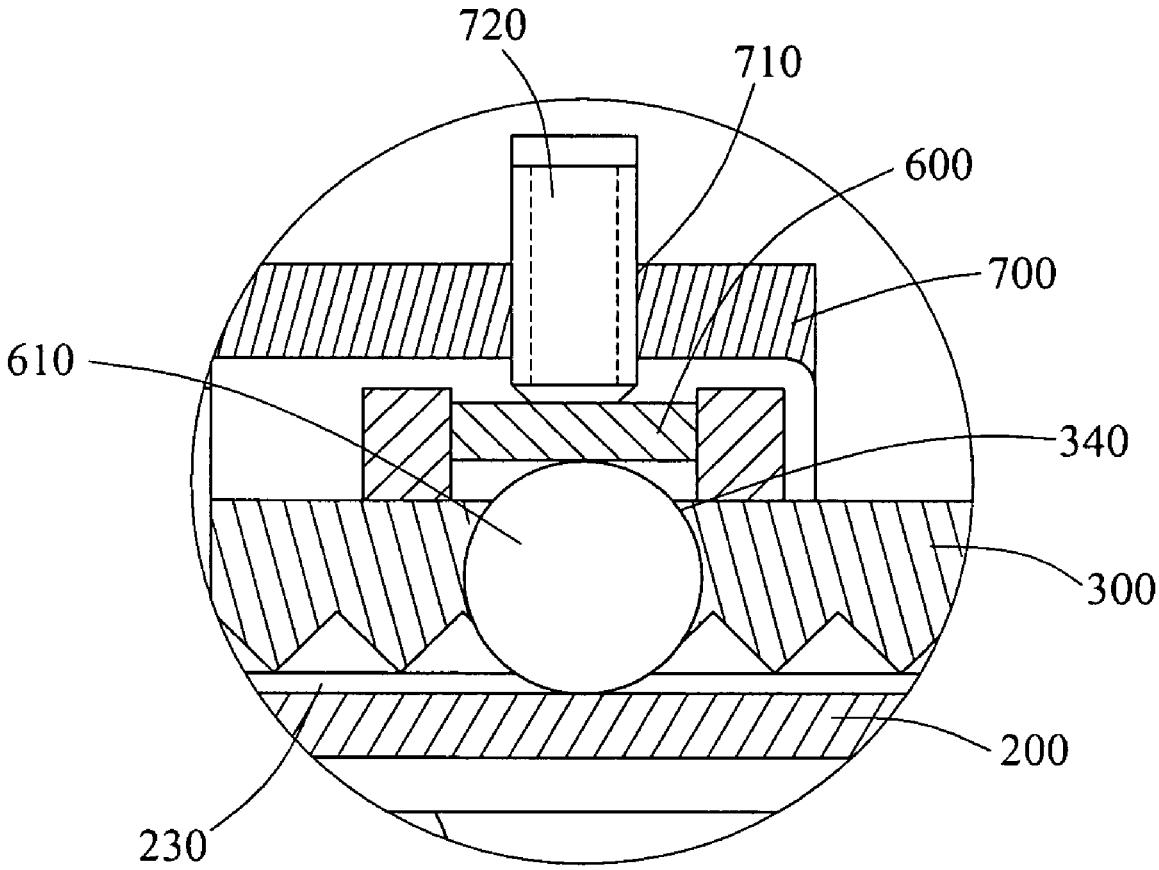
FIG. 8 is a partial enlarged view of FIG. 4A.

Referring to FIGS. 7 and 8, a sectional view of part of the elements according to the embodiment of the invention is shown. During the torque tool is operated, to prevent the maximum value of the torque output from being changed due to disengagement of the positioning ball 610 caused by factors such as vibration and impact, in the embodiment of the present invention, a torque regulating ring 700 is put around the second tubular shell 300 and cover the elastic ring 600. The torque regulating ring 700 has a plurality of screw holes 710 corresponding to the apertures 340 of the second tubular shell 300, and each screw hole is used for a screwing element 720 to be screwed into. The number of the screw holes 710 is identical to the number of the apertures 340 of the second tubular shell 300. The position of each screw hole 710 corresponds to each aperture 340, such that the front tip of the screwing element 720 passes through the aperture 340, to make the front tip of the screwing element 720 moving toward the groove 230 and press against the positioning ball 610 via the elastic ring 600 when the screwing element 720 is screwed into the screw hole 710, so as to improve its fixing effect, prevent the positioning ball 610 from being disengaged from the groove 230 due to the vibration in the operational process, and change its relative position with the first tubular shell 200 by directly forcing the second tubular shell 300 to move. The number of positioning balls 610 does not have to be identical to the number of the grooves 230, and can be less than the number of the screwing elements 720. For example, one positioning ball 610 can be adopted, and pressed by a screwing element 720, with the rest of the screwing elements 720 directly pressing against the elastic ring 600, so as to balance the relative position between the torque regulating ring 700 and the second tubular shell 300.

Figure 9:
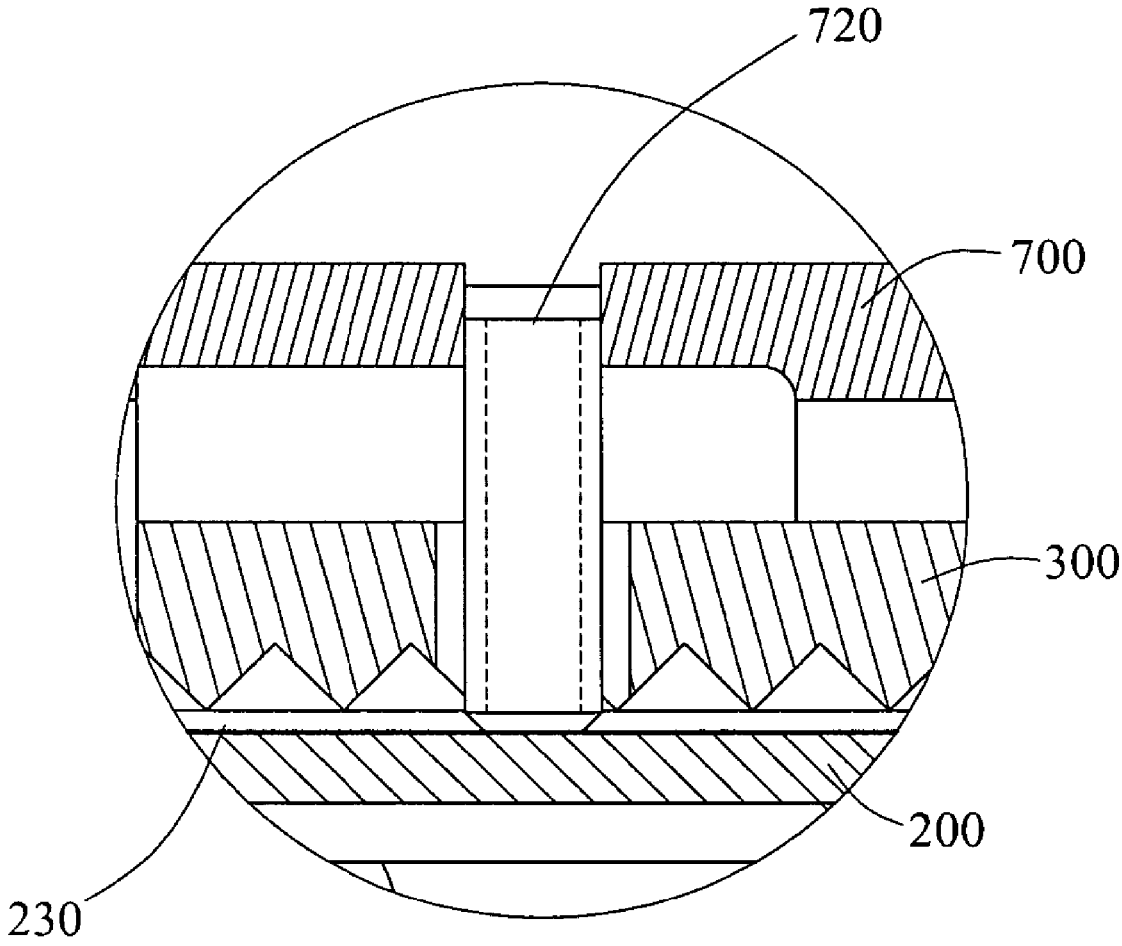
FIG. 9 is a partial enlarged view of another aspect of the first embodiment of the invention.

Referring to FIG. 9, the elastic ring 600 and the positioning ball 610 can be canceled to make the front tip of the screwing element 720 directly inserted into the groove 230 through the aperture 340, so as to fix the relative position between the second tubular shell 300 and the first tubular shell 200.

Figure 10:
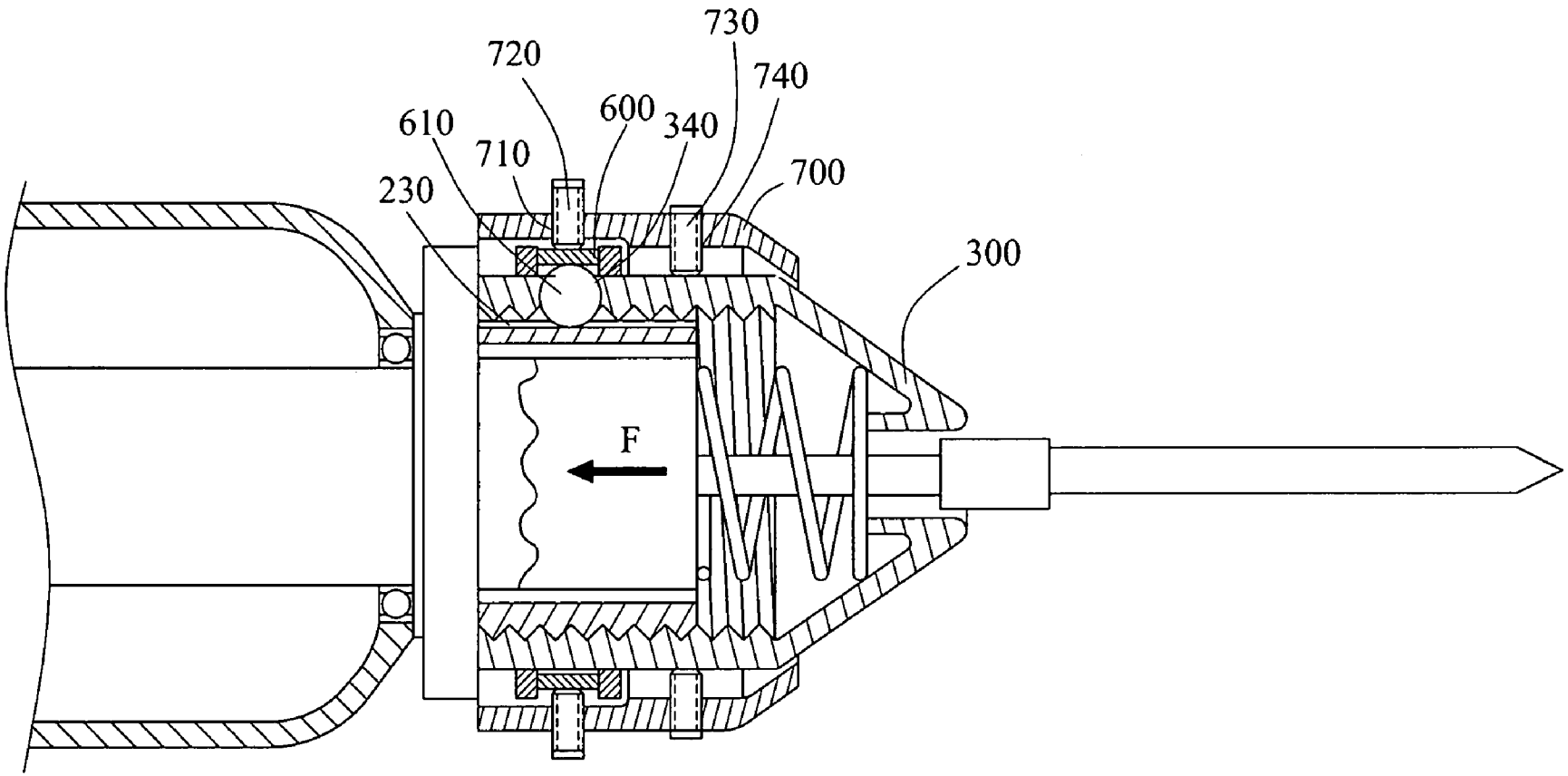
FIG. 10 is a schematic sectional view of the second embodiment of the invention.

Referring to FIG. 10, it is a schematic sectional view of the torque regulating assembly according to the second embodiment of the invention. The main structure of the present embodiment is similar to the first embodiment, except for the following differences. Two groups of screw holes 710, 740 are disposed in the torque regulating ring 700, wherein one group of the screw holes 710 corresponds to the apertures 340 of the second tubular shell 300, enabling the screwing element 720 to press against the positioning ball 610 via the elastic ring 600, for preventing the positioning ball from being disengaged from the groove 230 of the first tubular shell 200: The other group of screw holes 740 is for guiding the front tip of another screwing element 730 to press against the external wall of the second tubular shell 300, for ensuring that the torque regulating ring 700 will not move relative to the second tubular shell 300, such that the first group of the screw holes surely corresponds to the apertures 340 of the second tubular shell 300, and every positioning ball 610 can be ensured to be pressed by the screwing element 720.

According to the preferred embodiments of the invention, the driving shaft is connected to an air device or a power motor for acquiring power source to rotate the driving shaft. However, it is not limited to that, and the driving shaft can also be fixed onto a grab handle, and be manually driven to rotate, which is applicable in operational occasions of small torque.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A torque regulating assembly, comprising:

a first tubular shell having at least one groove disposed along the longitudinal axis of the first tubular shell;

a second tubular shell having at least one aperture, wherein the first tubular shell is screwed into the second tubular shell with threads, and a linear relative displacement of the second tubular shell to the first tubular shell is generated via their relative rotation;

a first coupling block and a second coupling block, disposed inside the first tubular shell and the second tubular shell, wherein the second coupling block presses against the first coupling block for the two to be coupled with each other;

an elastic element, with two ends respectively pressing against the second tubular shell and the second coupling block, for generating an elastic force to push the second coupling block pressing against the first coupling block;

a positioning ball, disposed in the aperture, partly engaged in the groove;

an elastic ring, put around the second tubular shell, and covering the aperture, wherein the elastic ring generates an elastic force to push the positioning ball;

a torque regulating ring, put around the second tubular shell, and covering the elastic ring wherein the torque regulating ring has at least one screw hole corresponding to the aperture; and a screwing element, screwed into the screw hole, pressing against the positioning ball by pressing the elastic ring with its front tip, for fixing the first tubular shell and the second tubular shell.

2. The torque regulating assembly according to claim 1, wherein one end of the second tubular shell is gradually contacted to form an opening.

3. The torque regulating assembly according to claim 2, wherein a tubular rib extending toward the interior of the second tubular shell is formed at the edge of the opening, and the elastic element is a compression spring with one end put around the rib.

4. The torque regulating assembly according to claim 1, wherein the first coupling block is connected one end of a driving shaft.

5. The torque regulating assembly according to claim 1, wherein another screw hole is further provided in the torque regulating ring, for guiding in another screwing element, such that the front tip of another screwing element presses against the external wall of the second tubular shell.

* * * * *